US010280557B2

(12) United States Patent
Kuan et al.

(10) Patent No.: US 10,280,557 B2
(45) Date of Patent: May 7, 2019

(54) STAND GARMENT STEAMER

(71) Applicant: KONINKLIJKE PHILIPS N.V., Eindhoven (NL)

(72) Inventors: Pooi Yeow Kuan, Eindhoven (NL); Yong Jiang, Eindhoven (NL); Yuqi Wang, Eindhoven (NL); Berkay Bircan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 21 days.

(21) Appl. No.: 15/527,729

(22) PCT Filed: Nov. 4, 2015

(86) PCT No.: PCT/EP2015/075653
§ 371 (c)(1),
(2) Date: May 18, 2017

(87) PCT Pub. No.: WO2016/078912
PCT Pub. Date: May 26, 2016

(65) Prior Publication Data

US 2017/0321371 A1 Nov. 9, 2017

(30) Foreign Application Priority Data

Nov. 19, 2014 (EP) ..... 14193945

(51) Int. Cl.
*D06F 87/00* (2006.01)
*D06F 81/00* (2006.01)
*D06F 81/08* (2006.01)

(52) U.S. Cl.
CPC ..... *D06F 87/00* (2013.01); *D06F 81/00* (2013.01); *D06F 81/08* (2013.01)

(58) Field of Classification Search
CPC ..... D06F 87/00; D06F 81/00; D06F 81/02; D06F 81/04; D06F 81/08; D06C 7/00
(Continued)

(56) References Cited

U.S. PATENT DOCUMENTS 3,397,472 A * 8/1968 Topliffe ..... D06F 81/08 108/33
6,807,758 B2 10/2004 Di Leta
(Continued)

FOREIGN PATENT DOCUMENTS

CN 202430546 U 9/2012
CN 202450345 U 9/2012
(Continued)

*Primary Examiner* — Ismael Izaguirre

(57) ABSTRACT

The present application relates to a stand garment steamer (1). The stand garment steamer (1) has a base unit (2), a support (19) extending from the base unit (2), and a treatment board (14) with a treatment surface (17) against which fabric is positionable. The treatment board (14) is supported and spaced from the base unit (2) by the support (19). A tilting mechanism (20) connects the support (19) to the treatment board (14), the tilting mechanism (20) being operable to allow the treatment board (14) to be fixed in multiple operating orientations between vertical and horizontal positions. A reversible generator is in the base unit (2), and at least one vent (18) is in the treatment surface (17) through which air and/or steam from the reversible generator is passable. A fluid pathway (47) fluidly connects the reversible generator and the at least one vent (18) irrespective of the operating orientation of the treatment board. This stand garment steamer improves ironing experience of users.

20 Claims, 7 Drawing Sheets

(58) Field of Classification Search
USPC ..... D32/17
See application file for complete search history.

(56) References Cited

U.S. PATENT DOCUMENTS 8,266,830 B2 * 9/2012 Ma ..... D06F 81/08
38/139
2013/0263465 A1 10/2013 Hu

FOREIGN PATENT DOCUMENTS

| | | | | |
|---|---|---|---|---|
| CN | 203156519 | U | | 8/2013 |
| CN | 203462334 | U | * | 3/2014 |
| DE | 2705511 | A1 | | 8/1978 |
| EP | 0750066 | A1 | | 12/1996 |
| EP | 976864 | A1 | * | 2/2000 |
| EP | 2474662 | A1 | * | 7/2012 |
| FR | 2695145 | A1 | * | 3/1994 |
| GB | 2285457 | A | | 7/1995 |
| WO | 2007057419 | A1 | | 5/2007 |
| WO | WO 2014163388 | A1 | * | 10/2014 |

* cited by examiner

STAND GARMENT STEAMER

This application is the U.S. National Phase application under 35 U.S.C. § 371 of International Application No. PCT/EP2015/075653, filed on Nov. 4, 2015, which claims the benefit of International Application No. 14193945.4 filed on Nov. 19, 2014. These applications are hereby incorporated by reference herein.

FIELD OF THE INVENTION

The present invention relates to a stand garment steamer.

BACKGROUND OF THE INVENTION

Stand garment steamers are used to remove creases from fabric, such as clothing and bedding, using steam. Stand garment steamers comprise a steamer head which is supplied steam from a stand base unit housing a steam generator and a water reservoir. The stand generally includes a hook or hanger on an upstanding support over which a garment or other fabric is hung to be treated with steam.

A user orientates the steamer head relative to the fabric to be treated by holding the steamer head which is connected to the stand by a hose. During use, steam is expelled from the steamer head and is directed towards the fabric to be treated, which hangs from the support.

Stretching of a fabric whilst performing the steaming operation is known to improve the de-wrinkling effect of applying steam to a fabric. It is known to have a stand garment steamer with a treatment board which sucks the fabric being treated onto the board, while user can stretch the fabric across the surface of the treatment board.

However, the known treatment boards of these stand garment steamers are typically difficult for the user to reposition when trying to optimise the de-wrinkling effect of the stand garment steamer on the fabric.

GB-A-2285457 discloses a rotatable ironing board which is pivotally mounted for rotation about its longitudinal axis in a vertical orientation. The board can be connected to a vacuum source so that the steam from a steam iron may be drawn through perforations in the board and thus through a garment on the board.

OBJECT AND SUMMARY OF THE INVENTION

It is an object of the invention to provide a stand garment steamer which substantially alleviates or overcomes the problems mentioned above.

The invention is defined by the independent claim; the dependent claims define advantageous embodiments.

According to the present invention, there is provided a stand garment steamer comprising a base unit, a support extending from the base unit, a treatment board with a treatment surface against which fabric is positionable, the treatment board being supported and spaced from the base unit by the support, a tilting mechanism connecting the support to the treatment board, the tilting mechanism being operable to allow the treatment board to be fixed in multiple operating orientations between vertical and horizontal positions, a reversible generator in the base unit, at least one vent in the treatment surface through which air and/or steam from the reversible airflow generator is passable, and a fluid pathway fluidly communicating the reversible generator and the at least one vent irrespective of the operating orientation of the treatment board.

Therefore, the fabric is held in position against the treatment surface of the garment support so that the user does not need to use their hand to position the fabric which helps to reduce the risk of the user being injured by the steam being discharged from the steamer head. Furthermore, the treatment board helps to position the fabric evenly to aid the removal of creases and the air which is drawn through the at least one vent helps to remove steam from the fabric once it has been used to treat the fabric. The reversible generator being spaced from the treatment board makes the treatment board lighter, less cumbersome and easier to support.

The tilting mechanism enables the user to choose which operating orientation to use the stand garment steamer in depending on the fabric that needs to be treated. As the stand garment steamer can be operated by the user when the treatment board is in a horizontal position, the user is able to press the steamer head against the fabric and use the steamer head like a steam iron by putting pressure on the treatment surface. Also, by allowing the stand garment steamer to be operated by the user when the treatment board is in a vertical position, gravity is utilised to further stretch the fabric lengthways.

The base unit may house components such as a water reservoir and a steam generator. Therefore, the stand garment steamer is an all in one steamer which provides the user with everything they need to steam fabric in one apparatus. The reversible generator located in the base unit gives the stand garment steamer a lower centre of gravity and increased stability. Furthermore, as the reversible generator is not located on the underside of the treatment board it is easier for the user to move the treatment board from one operating orientation to another.

At least part of the fluid pathway may be defined in the support

The complexity of the stand garment steamer can be reduced as there are fewer parts. Furthermore, the support is unlikely to be damaged and therefore, prevents the leakage of airflow.

The support may define a fluid conduit, the fluid conduit forming the at least part of a fluid pathway between the at least one vent in the treatment surface and the base unit.

Therefore, the appearance of the stand garment steamer is enhanced by hiding at least part of the fluid pathway within the support. Furthermore, the fluid pathway can not become tangled up with a steam hose which feeds steam to the steamer head.

The support may comprise a post, and the post may form the fluid conduit.

Therefore, there is no need for an external hose to extend along the fluid conduit in the support. This increases the robustness of the stand garment steamer because the at least part of the conduit is formed from material that is less likely to break or leak.

The stand garment steamer may further comprise a hose fluidly communicating the fluid conduit and the treatment board.

The flexibility of the hose allows it to twist and/or bend when the treatment board is moved between operating conditions without breaking and helps to avoid failures and leaks.

The treatment board may be pivotable relative to the support between the at least two operating orientations.

Therefore, moving the treatment board from one operating orientation to another is simple for the user because all the user has to do is rotate the treatment board.

The support may extend between the base unit and the treatment board such that the base unit is at the opposite end of the support to the treatment board.

The support enables the treatment board to be placed at a convenient height for the user to operate the stand garment steamer.

The base unit may form a base of the stand garment steamer.

The base provides a stable platform to prevent the user knocking or tipping over the stand garment steamer during use over no matter which operation orientation the treatment board is in.

The reversible generator may be configured to generate an airflow in the fluid pathway to draw air through the at least one vent.

The reversible generator is able to constantly draw air through the at least one vent so that the fabric is positioned and unable to move. This helps to ensure a more effective removal of creases from the fabric.

The reversible generator may be configured to generate an airflow in the fluid pathway to expel air from the at least one vent.

The reversible generator can be used to expel fluid through the at least one vent to dry the fabric or may be used to steam an entire fabric at once.

The treatment board may be planar.

The planar, flat, surface helps to ensure that creases are efficiently removed from the fabric placed on the treatment board.

The garment support may further comprise a hanging element on the treatment board to support a fabric.

This ensures that the fabric does not fall off the treatment surface in the event that the suction force of the reversible generator through the air vents is not large enough. Furthermore, the hook prevents fabric from falling when the stand garment steamer is turned off or is used in blowing mode. The hook enables use of the stand garment steamer even when the reversible generator is not being operated.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
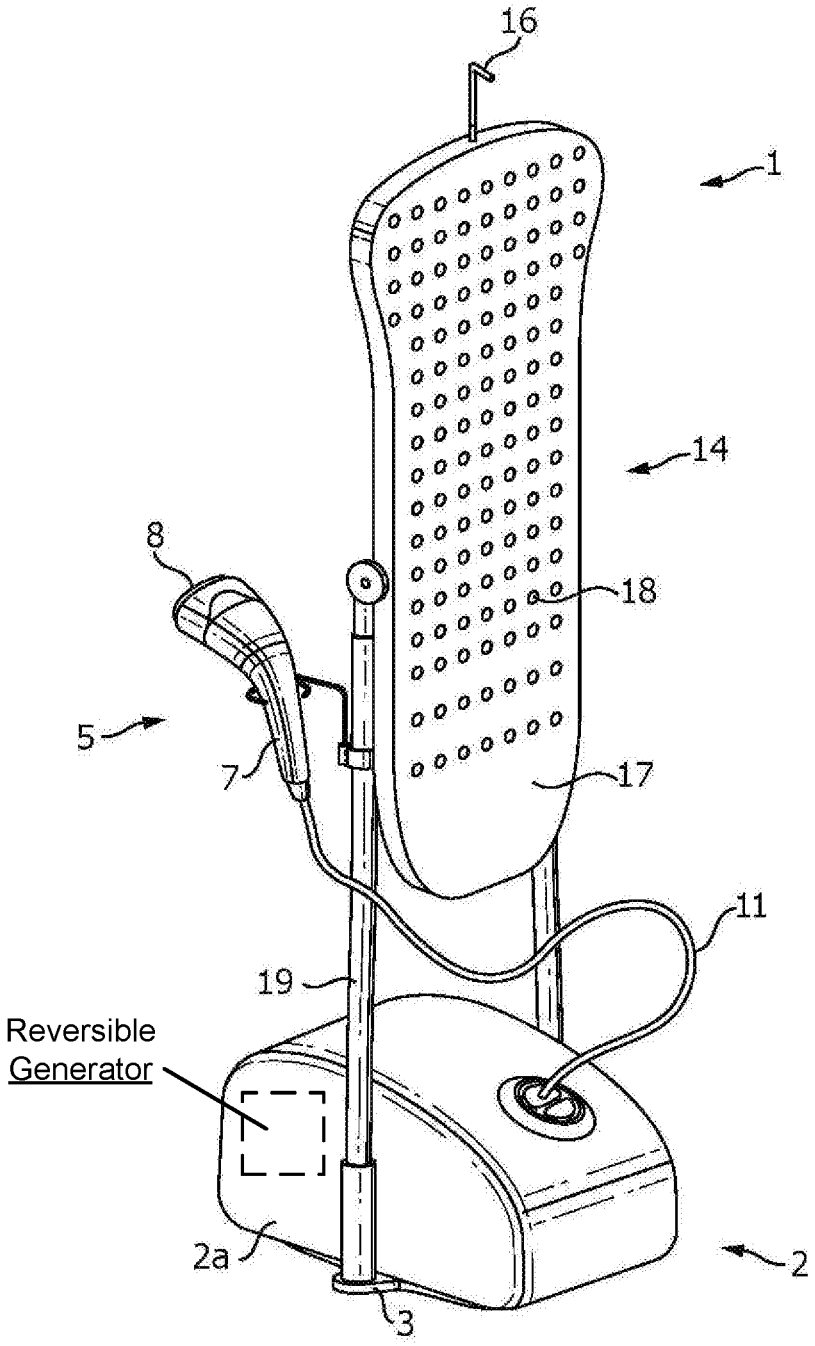
FIG. 1 is a schematic perspective front view of a first embodiment of a stand garment steamer according to the invention having a treatment board shown in a vertical orientation.
Figure 2:
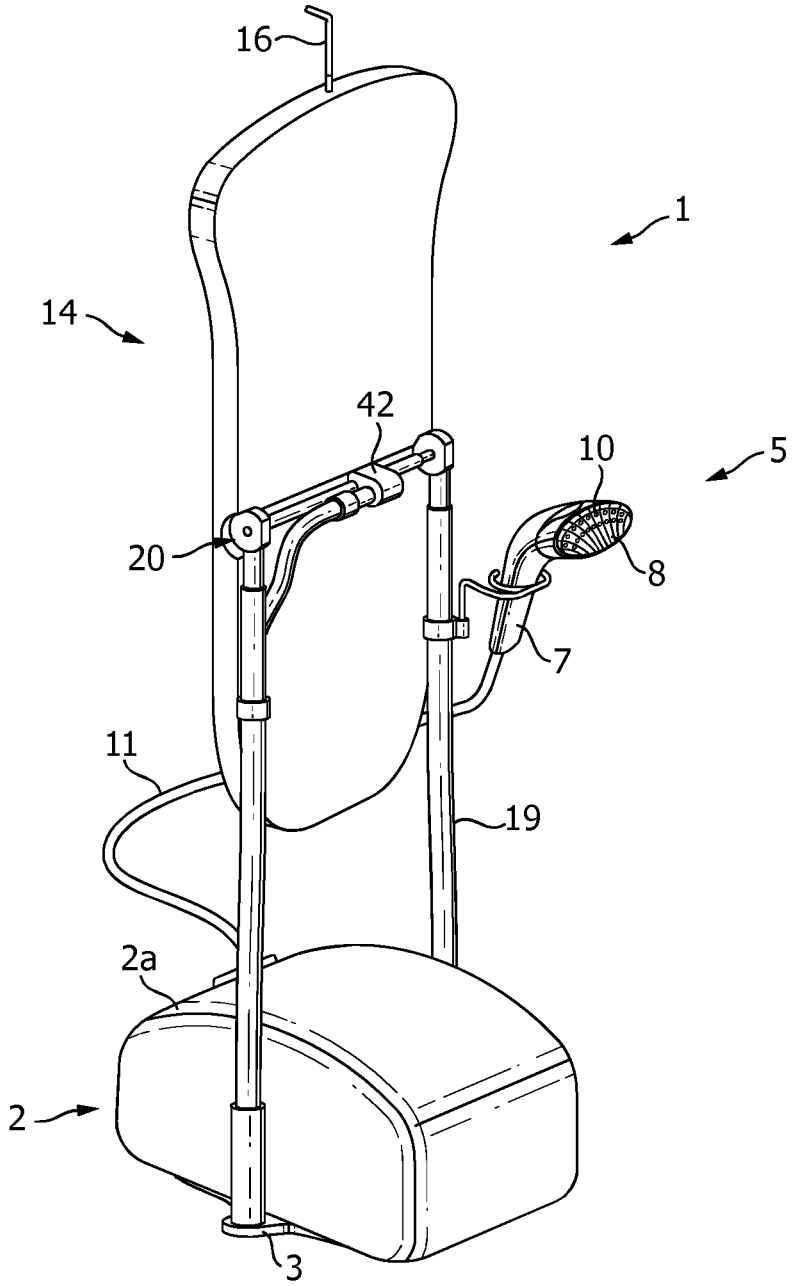
FIG. 2 is a schematic perspective rear view of the stand garment steamer, as shown in FIG. 1, with the treatment board shown in the vertical orientation.

Referring to FIG. 1 and FIG. 2, there is shown a stand garment steamer 1. The stand garment steamer 1 generates steam which is used to heat and moisten a fabric (not shown) to aid the removal of creases from the fabric. Fabrics to be treated include, but are not limited to, clothing. The fabric to be treated is supported by the stand garment steamer 1 during treatment.

The stand garment steamer 1 comprises a base unit 2, a treatment board 14, and a support 19. The support 19 supports the treatment board 14. The support 19 extends between the base unit 2 and the treatment board 14.

The base unit 2 has a water reservoir (not shown) and a steam generator (not shown). The base unit 2 has a housing 2*a*. The water reservoir and steam generator are in the housing 2*a*. The steam generator is a boiler. The water reservoir stores water which is fed into the steam generator to be converted to steam. It will be understood that the water reservoir and the steam generator may be integral. The base unit 2 further comprises a reversible airflow generator (not shown).

The base unit 2 defines a base 3 of the stand garment steamer 1. The base 3 defines a planar surface which is positionable against a floor, for example, to support the stand garment steamer 1. It will be understood that the base 3 may be formed from two or more planar surfaces extending on a plane, for example the lower faces of four feet (not shown). In the present description, the plane of the base 3 defines a horizontal plane.

One end of a steamer hose 11 extends from the base unit 2. The steamer hose 11 fluidly communicates with the steam generator (not shown) such that steam generated by the steam generator flows along the steamer hose 11. A steamer head 5 is disposed at the other end of the steamer hose 11. The steamer head 5 fluidly communicates with the base unit 2 via the flexible steamer hose 11. Therefore, steam from the steam generator is supplied to the steamer head 5.

The steamer head 5 has a handle portion 7 and a steamer plate 8. The handle portion 7 is configured to allow a user to hold the steamer head 5. The steamer plate 8 acts as a steamer face. The steamer plate 8 is configured to be positioned against the fabric to be treated. The handle portion 7 and the steamer plate 8 are at opposing ends of the steamer head 5.

The steamer head 5 has a steam outlet 10 (refer to FIG. 2). The steam outlet 10 is formed by one or more steam openings through which steam is expelled from the steamer head 5 during use. The steam outlet 10 fluidly communicates with the steamer hose 11. Therefore, steam provided to the steamer head 5 is expelled from the steamer head 5 through the steam outlet 10.

The treatment board 14 is pivotable about the support 19. That is, the orientation of the treatment board 14 is movable relative to the plane of the base 3. The treatment board 14 is shown in FIGS. 1 and 2 in a vertical orientation. The treatment board 14 acts as a garment support. The treatment board 14 is configured to receive a fabric thereagainst and help position the fabric in a manner that enhances the removal of creases. In the present embodiment, the treatment board 14 is generally rectangular. The treatment board 14 is elongate. The treatment board 14 comprises a treatment surface 17. The treatment surface 17 is generally planar. However, it will be understood that alternative configurations are possible.

The treatment board 14 is configured to be rigid in order to withstand the forces applied on the treatment board 14 by the user during steaming, so that bending of the treatment surface 17 is reduced and the fabric remains in place and stretched correctly. The treatment board 14 comprises a hanging element 16 at one end. The hanging element 16 may be, for example, but not limited to, a hook or a hanger. Vents 18 are formed in the treatment surface 17.

Figure 3:
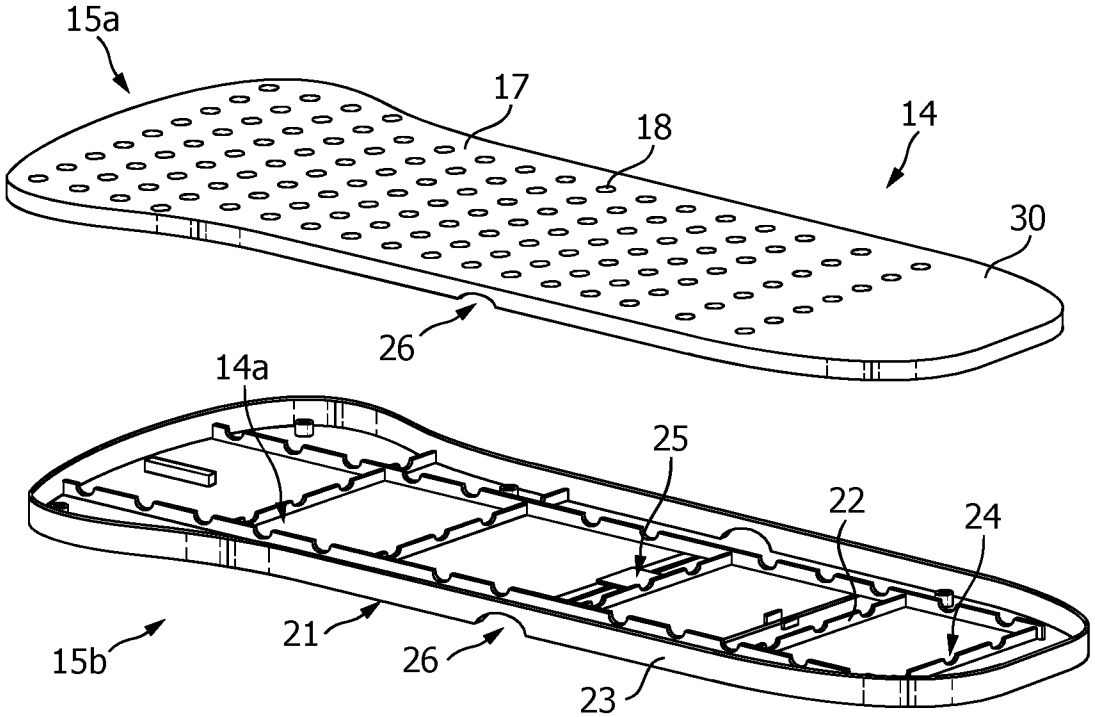
FIG. 3 is a schematic exploded perspective view of the treatment board, shown in FIG. 1.

Referring to FIG. 3, the treatment board 14 has an upper part 15*a* and a lower part 15*b*. The upper part 15*a* forms the treatment surface 17. The lower part 15*b* defines a rear side of the treatment board 14. The treatment board 14 is hollow and defines a steam distribution space 14*a*. The vents 18 fluidly communicate with the steam distribution space 14*a*.

However, it will be understood that in an alternative embodiment the treatment surface 17 may be formed by a different part, for example, but not limited to, a board cover (not shown). The board cover may be made from a flexible material which can be stretched over the treatment board 14. The board cover may be formed from a material such as, but not limited to, cotton, cotton-polyester blend, or cotton-polyurethane laminate. The board cover may provide a smooth surface to facilitate steaming and manage condensation.

The treatment board 14 has a rear wall 21. The rear wall 21 is on the opposing side of the treatment board 14 to the treatment surface 17. Internal walls 22, acting as internal support elements, upstand in the steam distribution space 14*a*. The internal walls 22 extend between the rear wall 21 and a front wall 30. The front wall 30 defines the treatment surface 17. The internal walls 22 extend perpendicularly from the base wall 21. The treatment board 14 further comprises a peripheral side wall 23. It will be understood that the number of internal walls 22 may vary, for example the treatment board 14 may have one internal wall 22.

The or each internal wall 22 comprises crenels 24. The crenels 24 are in the form of cut-outs in the top of the internal walls 22. The internal walls 22 allow support of the treatment surface 17 to be distributed across the treatment board 14. The number of crenels 24 may vary. The crenels 24 act as steam holes through which steam is able to pass to aid distribution of steam in the steam distribution space 14*a*.

In the present embodiment, the layout of the internal walls 22 is symmetrical about a longitudinal axis of the treatment board 14. Two internal walls 22 extend perpendicularly from the rear wall 21 and run parallel to the longitudinal axis of the treatment board 14. Five internal walls 22 extend perpendicularly from the rear wall 21 and run parallel to a lateral axis of the treatment board 14. That is, the lateral internal walls 22 run perpendicularly to the longitudinal internal walls 22.

The upper part 15*a* of the treatment board 14 is formed from a light material which reduces the overall weight of the treatment board 14 and reduces the amount of heat needed to heat it up which reduces the condensation rate on the treatment surface 17. Therefore, the number of "wet-spots" that occur on the fabric being treated are reduced. The upper part 15*a* of the treatment board 14 may be formed from, for example, but not limited to, expanded polypropylene.

The lower part 15*b* of the treatment board 14 is formed from a light but strong material which prevents the treatment board 14 bending during use. The lower part 15*b* of the treatment board may be formed from, for example, but not limited to, polypropylene.

The treatment board 14 further comprises recesses 26 which are formed on either side of the lower part 15*b* of the treatment board 14. The recesses 26 are configured to receive a tilting mechanism 20 for enabling the orientation of the treatment board 14 to be changed. Furthermore, a frame orifice 25 is formed through the rear wall 21 of the lower part 15*b*. In the present embodiment, the frame orifice 25 is located in the centre of the rear wall 21 of the treatment board 14.

The top end of the peripheral side wall 23 and the treatment surface 17 provide a flat surface for removing creases from a fabric. This is because the internal walls 22 extend from the base wall 21 of the lower part 15*b* to the front wall 30 of the treatment board 14. The internal walls 22 may extend into the front wall 30 of the upper part 15*a* of the treatment board 14. The internal walls 22 space the front wall 30 from the rear wall 21 to create the steam distribution space 14*a*.

The support 19 of the stand garment steamer 1 is configured to space the base unit 2 from the treatment board 14. In the present embodiment, the support 19 of the stand garment steamer 1 comprises two legs 27, refer to FIG. 4 and FIG. 5. One leg 27 extends from each side of the base unit 2. The support 19 positions the treatment board 14 above the base unit 2. The legs 27 of the support 19 are, for example, but not limited to, cylindrical tubes. The tubes are hollow. The hollow support 19 helps to reduce the overall weight of the stand garment steamer 1.

Figure 4:
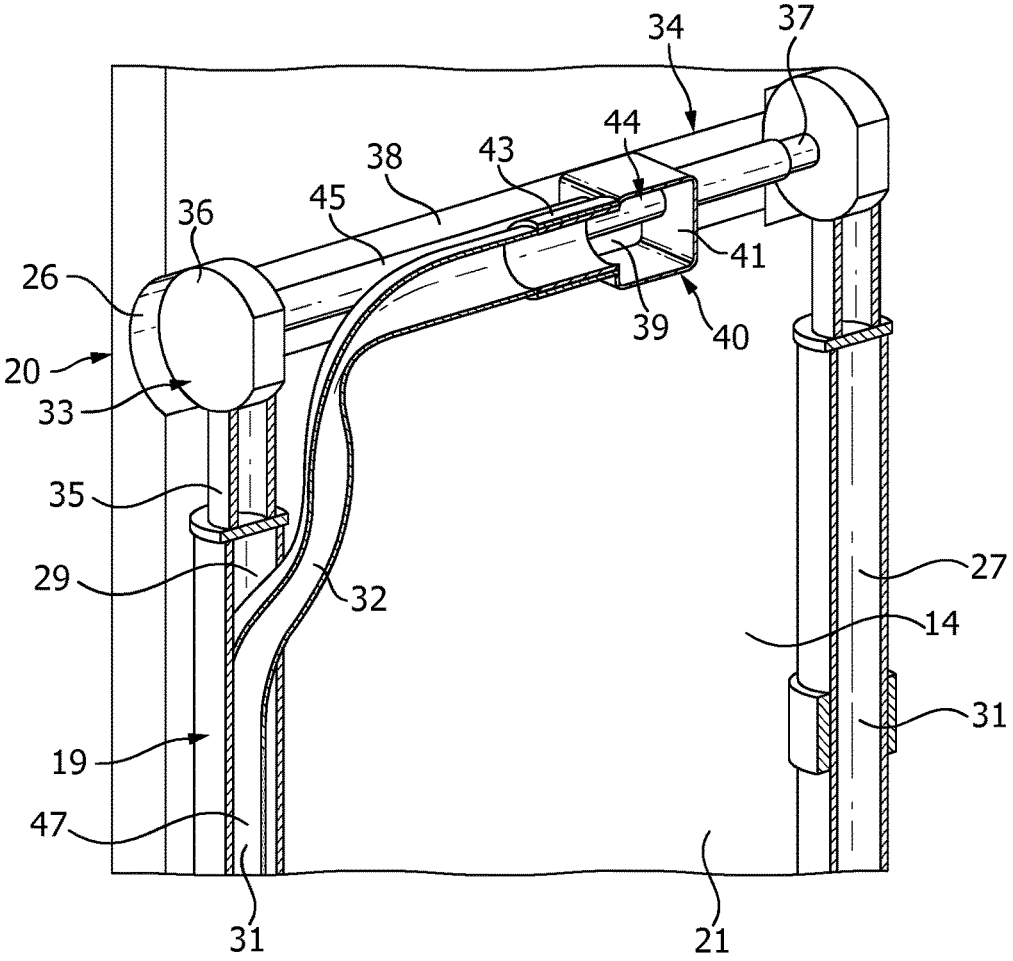
FIG. 4 is a schematic perspective rear view of a tilting mechanism of the stand garment steamer shown in FIG. 2, with the treatment board shown in its vertical position and a section of the tilting mechanism and a hose shown cutaway.
Figure 5:
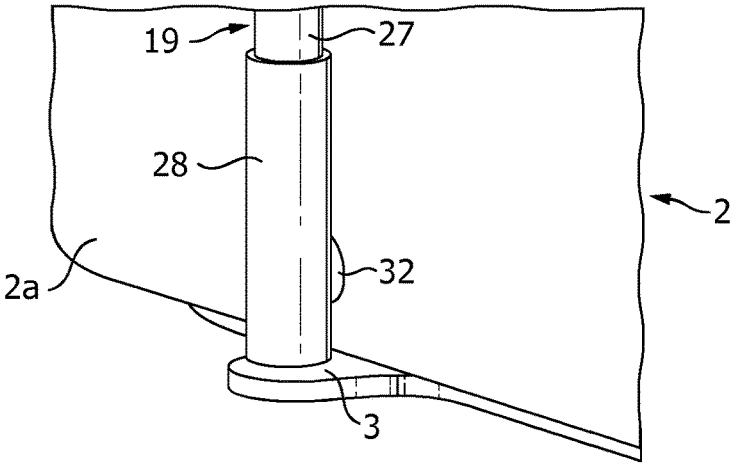
FIG. 5 is a schematic perspective view of part of the lower end of a support of the stand garment steamer shown in FIG. 1.

Referring to FIG. 4 and FIG. 5, views of the support 19 attached to the treatment board 14 and the base unit 2 are shown, respectively. FIG. 5 shows the lower part of the support 19. FIG. 5 shows the base 3 protruding beyond the side walls of the housing 2*a*. Extending from the top surface of the base 3 is a base support attachment 28. The base support attachment 28 is configured to receive the support 19 and attach it to the base unit 2.

The base support attachment 28 is a hollow cylindrical tube. The base support attachment 28 extends upwards perpendicularly from the protruding part of the base 3. It will be understood that the base 3 with the base support attachment 28 may be integrally formed with the support 19.

The base 3 helps to provide the stand garment steamer 1 with better stability. In the present embodiment, the base support attachment 28 helps to prevent the legs 27 of the support 19 from diverging during use. The base support attachment 28 strengthens the joint between the base 3 and the support 19. This helps to ensure that the stand garment steamer 1 does not break, bend, or buckle when the user applies pressure on the treatment surface 17 of the treatment board 14, shown in FIG. 1.

In the present embodiment, the support 19 comprises a lower support aperture (not shown). The lower support aperture is located proximate to the base 3. The lower support aperture extends through the wall of the support 19 and the base support attachment 28. The lower support aperture is located proximate to the housing 2*a* of the base unit 2.

Referring now to FIG. 4, the upper part of the support 19 is shown with a portion cut-away. The support 19 further comprises an upper support aperture 29. The upper support aperture 29 is located proximate to the treatment board 14. The upper support aperture 29 is located on the inner part of the support 19. That is, the upper support aperture 29 faces the opposite leg 27 of the support 19.

The support 19 defines a fluid conduit 31. In the present embodiment, the fluid conduit is formed by the inside of the hollow cylindrical leg 27. The fluid conduit 31 is defined between the lower support aperture (not shown) and the upper support aperture 29. The fluid conduit 31 forms at least part of a fluid pathway 47 between the vents 18 in the treatment surface 17 and the reversible airflow generator (not shown) in the base unit 2, shown in FIG. 1.

In the present embodiment, shown in FIG. 4 and FIG. 5, a hose 32 extends from the housing 2*a* of the base unit 2 and enters the fluid conduit 31 in the support 19 via the lower support aperture (not shown). The hose 32 extends up the support 19 and exits the fluid conduit 31 via the upper support aperture 29. The hose 32 then fluidly connects to the steam distribution space 14*a*, shown in FIG. 3, in the treatment board 14.

It will be understood that in an alternative embodiment the hose 32 will fluidly connect the base unit 2 to the lower support aperture (not shown) and the upper support aperture 29 to the steam distribution space 14*a*, shown in FIG. 3, in the treatment board 14 but will not extend between the upper and lower support apertures. Therefore, the inside of the leg 27 of the support 19 will form the fluid conduit 31. The support 19 may be air tight to allow air to flow from the upper support aperture 29 along the fluid conduit 31 to the lower support aperture (not shown) without leaking.

The tilting mechanism 20, shown in FIG. 2, of the stand garment steamer 1 connects the support 19 of the stand garment steamer 1 to the treatment board 14. The tilting mechanism 20 is configured to allow the treatment board 14 to be fixed in multiple operating orientations between vertical and horizontal, inclusive, as will be described in more detail hereinafter.

Referring to FIG. 4, a detailed view of the tilting mechanism 20 is shown with a section of the tilting mechanism 20 and the hose 32 cut-away. The tilting mechanism 20 mounts the treatment board 14 on the support 19. The tilting mechanism 20 also facilitates rotation of the treatment board 14 relative to the support 19 and the base unit 2.

The tilting mechanism 20 comprises a first hinge portion 33 and a second hinge portion 34. The first hinge portion 33 comprises a support attachment portion 35 configured to mount the tilting mechanism 20 onto the support 19. The support attachment portion 35, which comprises a cylindrical tube, is configured to attach to a top portion of the leg 27 of the support 19. The top portion of the support 19 and the support attachment portion 35 of the first hinge portion 33 are held together by any suitable known engagement arrangement (not shown).

The first hinge portion 33 further comprises a disc portion 36. The disc portion 36 is substantially cylindrical. The disc portion 36 extends perpendicularly from the support attachment portion 35. The circumference of the disc portion 36 is connected to the top of the support attachment portion 35.

A shaft 37 extends from the disc portion 36. The shaft 37 extends perpendicularly from an end of the cylindrical disc portion 36. The shaft 37 extends from the centre of the generally circular shaped end face of the disc portion 36.

In the present embodiment, the support 19 of the stand garment steamer 1 comprises two legs 27. Each leg comprises a first hinge portion 33 having the support attachment portion 35 and the disc portion 36. The generally circular faces of each disc portion 36 are parallel to each other. The shaft 37 extends between the two disc portions 36 and connects the first hinge portions 33.

A segment of each disc portion 36 is located in one of the recesses 26 formed in the lower part 15*b* of the treatment board 14. Each disc portion 36 is positioned so as to make an air tight seal between the tilting mechanism 20 and the treatment board 14. However, the air tight seal is also configured to allow the treatment board 14 to rotate relative to the first hinge portion 33 of the tilting mechanism 20.

The second hinge portion 34 is configured to mount the treatment board 14 onto the tilting mechanism 20. The second hinge portion 34 comprises a frame attachment portion 38. The frame attachment portion 38 is a rectangular member which is fixed to the rear wall 21 of the treatment board 14 and extends between the recesses 26 which receive the disc portions 36 of the first hinge portion 33.

The frame attachment portion 38 comprises a frame attachment portion orifice 39. In the present embodiment, the frame attachment portion orifice 39 is located centrally in the frame attachment portion 38. The frame attachment portion orifice 39 generally corresponds to the frame orifice 25, shown in FIG. 3, in the rear wall 21 of the treatment board 14. That is, the frame attachment portion orifice 39 is located in line with the frame orifice 25. Furthermore, the frame attachment portion orifice 39 is substantially the same shape and size as the frame orifice 25.

The second hinge portion 34 further comprises a fluid connection portion 40. The fluid connection portion 40 connects the hose 32 to the frame attachment portion orifice 39. Walls 41 extend perpendicularly from the frame attachment portion 38 on the edge of the frame attachment portion orifice 39. The walls 41 extend from the frame attachment portion 38 to an end wall 42, shown in FIG. 2.

A sealing arrangement 43 extends perpendicularly from one of the walls 41. The sealing arrangement 43 is a hollow cylindrical tube which extends towards the support 19. The sealing arrangement 43 is configured to attach the hose 32 to the steam distribution space 14*a*, shown in FIG. 3, of the treatment board 14 via the fluid connection portion 40 of the tilting mechanism 20. The sealing arrangement 43 may be, for example, but not limited to, an o-ring.

The shaft 37 extends through shaft apertures 44 in the walls 41 which are parallel to the disc portions 36. The shaft apertures 44 are fluidly sealed. The second hinge portion 34 further comprises a sheath 45. The sheath 45 extends perpendicularly from the walls 41 which comprise the shaft apertures 43. The sheath 45 is a hollow cylindrical tube which extends over the shaft 37.

The shaft 37 is fixed relative to the first hinge portion 33 and the second hinge portion 34 rotates about the shaft 37. However, in an alternative embodiment, it will be understood that the shaft 37 is fixed relative to the second hinge portion 34. Therefore, the second hinge portion 34 and the shaft 37 will rotate relative to the disc portions 36 of the first hinge portions 33.

The tilting mechanism 20 further comprises a locking arrangement (not shown). The locking arrangement is configured to fix the treatment board 14 in operating orientations at various angles to help the user remove creases from fabric. For example, the locking arrangement may allow the treatment board 14 to be placed at 0, 30, 60, and 90 degrees to the vertical whilst the stand garment steamer 1 is being used. It will be understood that in an embodiment of the present invention any suitable locking arrangement can be used to fix the treatment board 14 in various positions relative to the horizontal.

The fluid passageway 47 of the stand garment steamer 1 fluidly connects the reversible airflow generator (not shown) with the vents 18, shown in FIG. 1. When the stand garment steamer 1 is operated in suction mode, the fluid passageway 47 starts at the vents 18. The reversible airflow generator creates a pressure difference which induces a flow of air through the vents 18 and into the steam distribution space 14*a* created in the treatment board 14 between the rear wall 21 and the treatment surface 17 of the treatment board 14.

The crenels 24 in the internal walls 22 allow air to be drawn through the vents 18 in the treatment surface 17 of the treatment board 14. The crenels 24 fluidly connect all the smaller chambers of the steam distribution space 14*a* together so that suction can be provided evenly across the treatment surface 17. The air then flows to the centre of the treatment board 14 and exits through the frame orifice 25. The frame orifice 25 is aligned with the frame attachment portion orifice 39 of the tilting mechanism 20. Therefore, the air flows through the fluid connection portion 40 of the tilting mechanism 20 and into the hose 32.

The hose 32 extends through the upper support aperture 29 and into the fluid conduit 31 in the support 19. The hose 32 exits the fluid conduit 31 in the support 19 through the lower support aperture (not shown) and enters the base unit 2 where the reversible airflow generator (not shown) is housed. The reversible airflow generator draws the air through and ejects it out a pump vent (not shown) in the base unit 2.

When the stand garment steamer 1 is in its blowing mode the reversible airflow generator (not shown) draws air through the pump vent (not shown) in the base unit 2 and ejects air out of the vents 18 in the treatment board 14.

In the present invention, the reversible airflow generator (not shown) is a machine or device for raising, compressing, or transferring fluids. The reversible airflow generator is used to raise a liquid or gas to a higher level of pressure and/or to move volumes of gas. Therefore, the reversible airflow generator may be, for example, but not limited to, a type of pump, compressor, blower, or fan.

In the present embodiment, the reversible airflow generator (not shown) comprises a bi-directional fan. The bi-directional fan is able to rotate in two opposing directions. The bi-directional fan is able to draw fluid from the treatment surface 17 in suction mode. The bi-directional fan is able to push fluid out of the treatment surface 17 in blowing mode. The bi-directional fan may comprise generally symmetrical blades to enhance performance in both directions.

It will be understood that, although referred to as air in the description above, the fluid drawn through the vents 18 in suction mode will be a mixture of steam ejected from the steamer head 5, when the steamer head 5 is ejecting steam proximate to the treatment surface 17, and air.

Furthermore, it will be understood that, although referred to as air in the description above, the fluid pushed through the vents 18 may be either steam from the steam generator, air or a combination of both steam and air.

Figure 6:
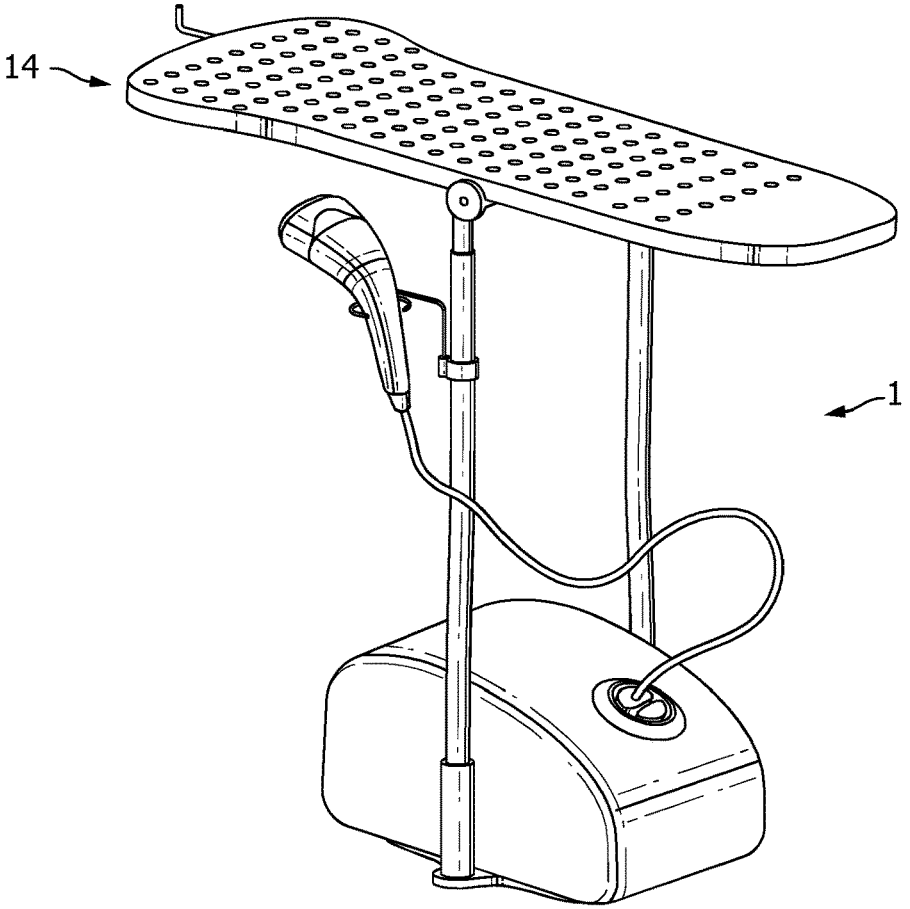
FIG. 6 is a schematic perspective front view of the stand garment steamer shown in FIG. 1, with the treatment board shown in a horizontal orientation.

Referring to now FIG. 6, the first embodiment of the stand garment steamer 1 is shown in a second operating orientation. That is, the treatment board 14 has been rotated to a horizontal position. The treatment board 14 is parallel to the base 3.

Figure 7:
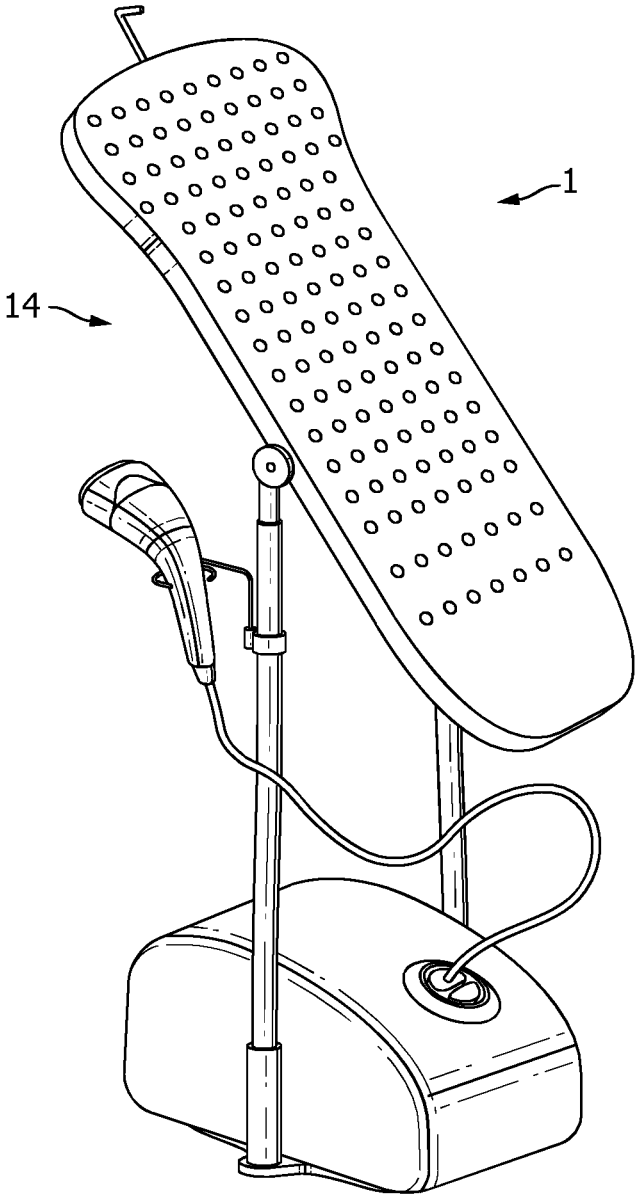
FIG. 7 is a schematic perspective front view of the stand garment steamer shown in FIG. 1, with the treatment board shown in an inclined orientation.

Referring now to FIG. 7, the first embodiment of the stand garment steamer 1 is shown in a third operating orientation. That is, the treatment board 14 has been rotated to an inclined position. The treatment board 14 makes an angle with the horizontal and vertical planes.

Figure 8:
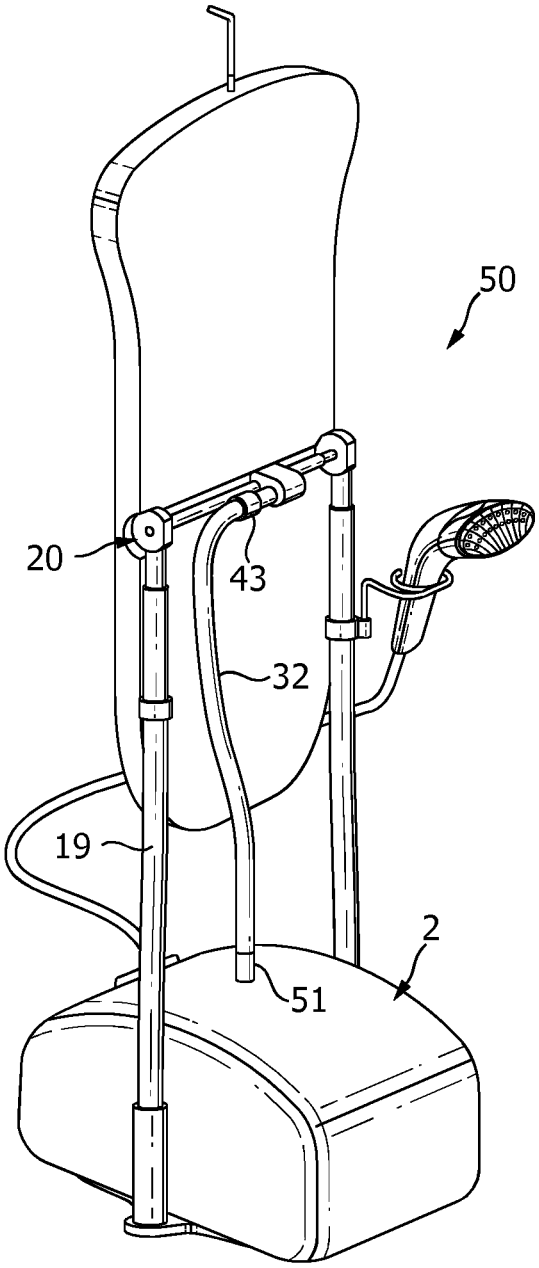
FIG. 8 is a schematic perspective rear view of another embodiment of the stand garment steamer according to the invention having a treatment board shown in a vertical orientation.

Referring now to FIG. 8, a second embodiment of the stand garment steamer 50 is shown. The stand garment steamer 50 shown in FIG. 8 is generally the same as the first embodiment described above and so a detailed description will be omitted herein. Features and components of the stand garment steamer 50 will retain the same terminology and reference numerals. However, the hose 32 shown in FIG. 8 does not extend through the fluid conduit 31, shown in FIG. 4, in the support 19. Instead the hose 32 extends downwards, directly from the sealing arrangement 43 of the tilting mechanism 20 to a hose connection 51 in the top wall of the base unit 2.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A stand garment steamer comprising:

a base unit;

a support extending from the base unit;

a treatment board with a treatment surface against which fabric is positionable, the treatment board being supported and spaced from the base unit by the support;

a generator in the base unit, wherein the generator is reversible;

at least one vent in the treatment surface through which fluid is passable;

a fluid pathway fluidly communicating the generator and the at least one vent; and a tilting mechanism connecting the support to the treatment board, the tilting mechanism being operable to allow the treatment board to be fixed in multiple operating orientations between vertical and horizontal positions, wherein at least part of the fluid pathway is defined in the support.

2. The stand garment steamer according to claim 1, further comprising a hose fluidly communicating (i) a fluid conduit in the support and (ii) the treatment board.

3. The stand garment steamer according to claim 1, wherein the treatment board is pivotable relative to the support between two operating orientations.

4. The stand garment steamer according to claim 1, wherein the support extends between the base unit and the treatment board such that the base unit is at the opposite end of the support to the treatment board.

5. The stand garment steamer according to claim 1, wherein the base unit forms a base of the stand garment steamer.

6. The stand garment steamer according to claim 1, wherein the reversible generator is configured to generate an airflow in the fluid pathway to draw air through the at least one vent.

7. The stand garment steamer according to claim 1, wherein the reversible generator is configured to generate an airflow in the fluid pathway to expel air from the at least one vent.

8. The stand garment steamer according to claim 1, wherein the treatment board is planar.

9. The stand garment steamer according to claim 1, further comprising a hanging element on the treatment board to support a fabric.

10. A stand garment steamer comprising:

a base unit;

a support extending from the base unit;

a treatment board with a treatment surface against which fabric is positionable, the treatment board being supported and spaced from the base unit by the support;

a generator in the base unit, wherein the generator is reversible;

at least one vent in the treatment surface through which fluid is passable;

a fluid pathway fluidly communicating the generator and the at least one vent; and a tilting mechanism connecting the support to the treatment board, the tilting mechanism being operable to allow the treatment board to be fixed in multiple operating orientations between vertical and horizontal positions, wherein the support defines a fluid conduit, the fluid conduit forming at least part of the fluid pathway between the at least one vent in the treatment surface and the reversible generator.

11. The stand garment steamer according to claim 10, wherein the support comprises a post, and the post forms the fluid conduit.

12. The stand garment steamer according to claim 10, further comprising a hose fluidly communicating the fluid conduit and the treatment board.

13. The stand garment steamer according to claim 12, wherein the support comprises a post, and the post forms the fluid conduit.

14. The stand garment steamer according to claim 10, wherein the treatment board is pivotable relative to the support between two operating orientations.

15. The stand garment steamer according to claim 10, wherein the support extends between the base unit and the treatment board such that the base unit is at the opposite end of the support to the treatment board.

16. The stand garment steamer according to claim 10, wherein the base unit forms a base of the stand garment steamer.

17. The stand garment steamer according to claim 10, wherein the reversible generator is configured to generate an airflow in the fluid pathway to draw air through the at least one vent.

18. The stand garment steamer according to claim 10, wherein the reversible generator is configured to generate an airflow in the fluid pathway to expel air from the at least one vent.

19. The stand garment steamer according to claim 10, wherein the treatment board is planar.

20. The stand garment steamer according to claim 10, further comprising a hanging element on the treatment board to support a fabric.

* * * * *